US009447593B2

(12) United States Patent
Plink et al.

(10) Patent No.: US 9,447,593 B2
(45) Date of Patent: Sep. 20, 2016

(54) SKIMMER DEVICE

(71) Applicants: Max Ronald Plink, Guildford (AU); Robert Willem Plink, Guildford (AU)

(72) Inventors: Max Ronald Plink, Guildford (AU); Robert Willem Plink, Guildford (AU)

( * ) Notice: Subject to any disclaimer, the term of this patent is extended or adjusted under 35 U.S.C. 154(b) by 634 days.

(21) Appl. No.: 13/859,247

(22) Filed: Apr. 9, 2013

(65) Prior Publication Data

US 2014/0305878 A1 Oct. 16, 2014

(30) Foreign Application Priority Data

Mar. 27, 2013 (AU) ..... 2013202087

(51) Int. Cl.
*E04H 4/12* (2006.01)

(52) U.S. Cl.
CPC ..... *E04H 4/1263* (2013.01)

(58) Field of Classification Search
CPC ..... E04H 4/1263
See application file for complete search history.

(56) References Cited

U.S. PATENT DOCUMENTS 3,700,109 A * 10/1972 Lasko ..... E02B 15/048 210/242.3
3,701,429 A * 10/1972 Schell ..... E02B 15/106 210/242.3
5,498,348 A 3/1996 Plink et al.
6,274,046 B1 * 8/2001 Lundback ..... E02B 15/106 210/170.05

FOREIGN PATENT DOCUMENTS

GB 1353806 A * 5/1974 ..... B01D 21/2433

* cited by examiner

*Primary Examiner* — Terry Cecil
(74) *Attorney, Agent, or Firm* — Ladas & Parry LLP

(57) ABSTRACT

A skimmer device for removal of debris and other contaminants from the surface of a body of liquid; said device including a central debris and contaminant collection element supported by outrigger buoyancy elements; said buoyancy elements ballasted by controlled charging of each of said elements with a volume of ballast liquid, and wherein an adjustment of buoyancy is provided by varying a volume of residual air retained in said buoyancy elements.

15 Claims, 3 Drawing Sheets

SKIMMER DEVICE

TECHNICAL FIELD

The present invention relates to skimming devices for removal of debris and other contaminants from a liquid surface.

BACKGROUND

Skimmers for use in bodies of liquid such as swimming pools are known. U.S. Pat. No. 5,498,348, to the present applicants, references a number of skimmers from which the disclosure of U.S. Pat. No. 5,498,348 is distinguished by the vertical oscillation of the device when in use, thereby preventing a build up of debris at the inlet weirs of the device.

One problem with the device of U.S. Pat. No. 5,498,348 is that of the ballasting system employed. To achieve the desired vertical oscillation, the buoyancy elements of the device required significantly weighty ballasting located towards the periphery of each of the buoyancy elements. The ballasting was effected in practice by including a block of steel or other dense material conforming in part at least to the configuration of the hollow chambers forming the buoyancy elements.

The ballasts of the device disclosed in U.S. Pat. No. 5,498,348 were therefore fixed once enclosed in the sealed hollow chambers of the buoyancy elements and did not allow of buoyancy adjustment.

A further problem with the ballasting arrangement of U.S. Pat. No. 5,498,348 lay in the considerable weight of the assembled device making it awkward to manipulate and place in a body of liquid for use. Moreover, this additional weight of the ballasting increased considerably the cost of transport with the associated problems of packing and handling.

The combination of very different materials for the structure of the device which was of a lightweight injection moulded polymer, and the enclosed steel ballast formed a further disadvantage in respect of ease of recycling.

It is an object of the present invention to address or at least ameliorate some of the above disadvantages.

Notes

The term "comprising" (and grammatical variations thereof) is used in this specification in the inclusive sense of "having" or "including", and not in the exclusive sense of "consisting only of".

The above discussion of the prior art in the Background of the invention, is not an admission that any information discussed therein is citable prior art or part of the common general knowledge of persons skilled in the art in any country.

SUMMARY OF INVENTION

Accordingly, in a first broad form of the invention, there is provided a skimmer device for removal of debris and other contaminants from the surface of a body of liquid; said device including a central debris and contaminant collection element supported by outrigger buoyancy elements; said buoyancy elements ballasted by controlled charging of each of said elements with a volume of ballast liquid, and wherein an adjustment of buoyancy is provided by varying a volume of residual air retained in said buoyancy elements.

Preferably, said buoyancy of each said buoyancy element is provided by a combination of any said residual air and an impervious cellular polymer body located within a hollow chamber forming said buoyancy element.

Preferably, each said hollow chamber includes a bottom surface formed of a radially outward and upward sloping first portion and a radially inward and upward sloping second portion; said second portion extending upwards towards said central debris and contaminant collection element; said buoyancy element further including a hollow liquid inlet shaft extending downwards from an upper end of said second portion; said liquid inlet shaft extending to proximate a level of a junction between said first and second portions.

Preferably, said second portion sloping upwards towards said central debris and contaminant collection element, biases said ballast liquid towards an outer periphery of said buoyancy element.

Preferably, said sloping surfaces of said first portion and said second portion aid in inducing a vertical oscillation of said skimmer device in use.

Preferably, said liquid inlet shaft is provided with at least one liquid inlet aperture proximate a lower end of said inlet shaft.

Preferably, each said buoyancy element is provided with an air bleed control valve at an upper surface of said hollow chamber.

Preferably, wherein said central debris and contaminant collection element includes three liquid passing weirs; each of said weirs extending between respective pairs of said buoyancy elements.

Preferably, generally vertical walls extend downwards from each said liquid passing weir; said walls further sloping inwards to form a funnel portion; an outlet of said funnel portion formed for connection of an outlet hose.

Preferably, said buoyancy elements are releasably and slidably connected at intersections of said generally vertical walls; sliding engagement providing for individual adjustment of said buoyancy elements relative a level of said liquid passing weirs.

Preferably, a liquid control valve is located at an aperture in one of said generally vertical walls; said valve including a pivoting hollow body responsive to liquid levels in said central debris and contaminant collecting element.

Preferably, said liquid control valve pivots from a first open position in which said liquid control valve permits flow of liquid into said central debris and contaminant collection element through an aperture in said generally vertical wall, and a second position in which said liquid control valve prevents said flow of liquid into said central debris and contaminant collection element.

Preferably, said liquid control valve remains in said position while there is a deficiency of liquid flow over said weirs and liquid level in said central debris and contaminant collection element is below said pivoting hollow body.

In another broad form of the invention, there is provided a method of providing adjustable ballasted buoyancy for a buoyancy element of a skimmer device; said method including the steps of:

placing a block of impervious cellular polymer within a hollow chamber of said buoyancy element, allowing ballast liquid to at least partially fill a remaining volume of said hollow chamber, and adjusting a volume of residual air remaining in hollow chamber.

Preferably, said buoyancy element is provided with an air bleed valve at an upper surface of said buoyancy element; said air bleed valve providing said adjustment of said volume of residual air.

Preferably, a control valve is responsive to differential liquid pressures between liquid outside of a debris collecting element and within said element; said control valve in combination with said ballast liquid inducing a vertical oscillation in said skimmer device in use.

Preferably, said suction pressure from a pump connected to an outlet of said device induces said differential liquid.

It is proposed that in this variation, ballast is provided by a volume of the liquid (typically water) in which the skimmer operates, rather then the insertion of a heavy ballast element at the bottom of the inside of the float.

That this weight be eliminated and be replaced by instead, filling a substantial portion of the free space within the float with water. (See FIG. 3 shaded area).

The float is constructed in such a way as to allow water to enter the internal chamber and fill it either completely or partially by turning it upside down while the float is submerged causing the air within to exit through holes in the lowest part of the float. When a sufficient portion of the air has exited, the float can then be turned around and as there is no way for air to enter the chamber while it is in this position the water will now act as a permanent source of ballast.

These holes can be positioned any where below the water line of the float when it is in normal floating position the preferred place for these openings however is in as low a position as possible so as not to allow air to accidentally enter the floats from below when water conditions are rough.

A valve can also be placed at the top of the float that may be opened to allow air to be bled from the float without having to turn the float upside down under the water.

Whereas in the previous method of float construction according to U.S. Pat. No. 5,498,348 buoyancy could not be changed in the revised version of the float it can be altered by allowing more or less air to stay within the float when it is in operating position.

Where as previously, simply the existence of air trapped within the confines of the float was all that was required to supply the buoyancy required now the floatation is to be confined within the float in the form of closed cell foam or any element that gives buoyancy in its own right.

The result of this variation is that the weight of the dragonfly super skimmer is reduced by approximately three Kilos while it is not in the water leading to increased safety in handling.

Reduced transportation cost as the unit is now lighter, reduced maintenance cost as when the stress on the float that was weighted with positive ballast was prone to develop leaks allowing water to enter the float inner chamber and this could not be repaired effectively therefore the float would have to be replaced.

Ecological and safety considerations are also improved as the unit is now lighter reducing energy and handling requirements in transportation, for both the raw materials and the finished product.

Particularly heavy materials were required to make the required balance between ballast and floatation within the weighted float which required that the ballast be made from iron shot or similar. Replacing this with the proposed method would have a significant impact on the carbon footprint caused in the production of this float.

The relationship and positioning of and between the ballast and buoyancy of the floats that support the Dragonfly Super skimmer in the water are an important part of it's operation and it is suggested that this is an innovative and inventive way of improving the safety, convenience and improve the environmental outcomes and recyclability of this product.

BRIEF DESCRIPTION OF DRAWINGS

Embodiments of the present invention will now be described with reference to the accompanying drawings wherein:

With reference to FIG. 1, a skimmer device 10 in a preferred embodiment of the invention, comprises a central debris and other contaminant collecting element 12 supported in a volume of liquid (not shown) by outrigger ballasted buoyancy elements 14.

Figure 1:
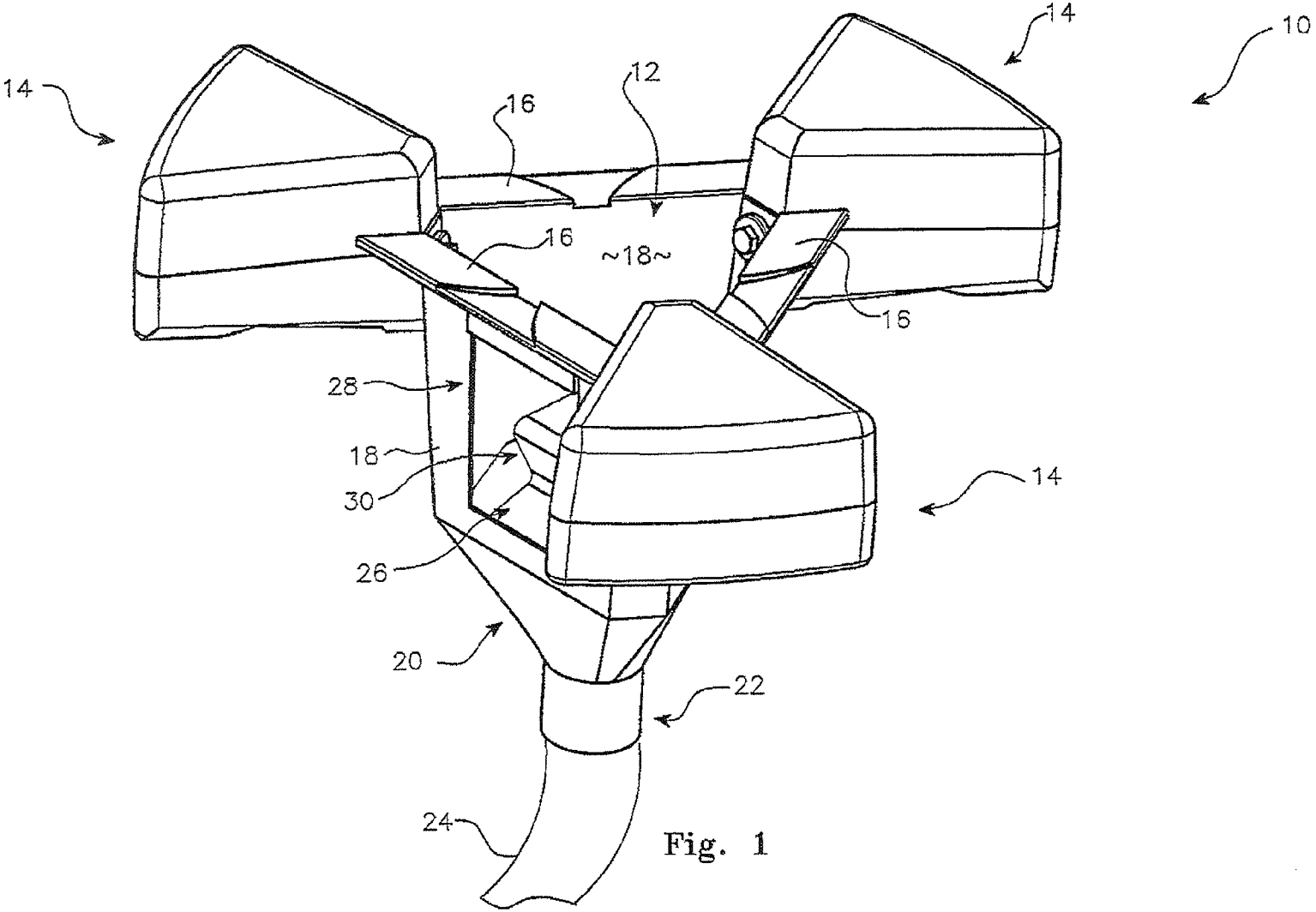
FIG. 1 is a perspective of a skimmer device according to the invention.

Preferably, collecting element 12 includes three liquid passing weirs 16 surmounting generally vertical walls 18 to form a triangular trough leading to a funnel portion 20. Funnel portion 20 is provided at the bottom end with a spigot 22 for connection to an outlet hose 24 leading to a pump and filtration system (not shown).

Figure 2:
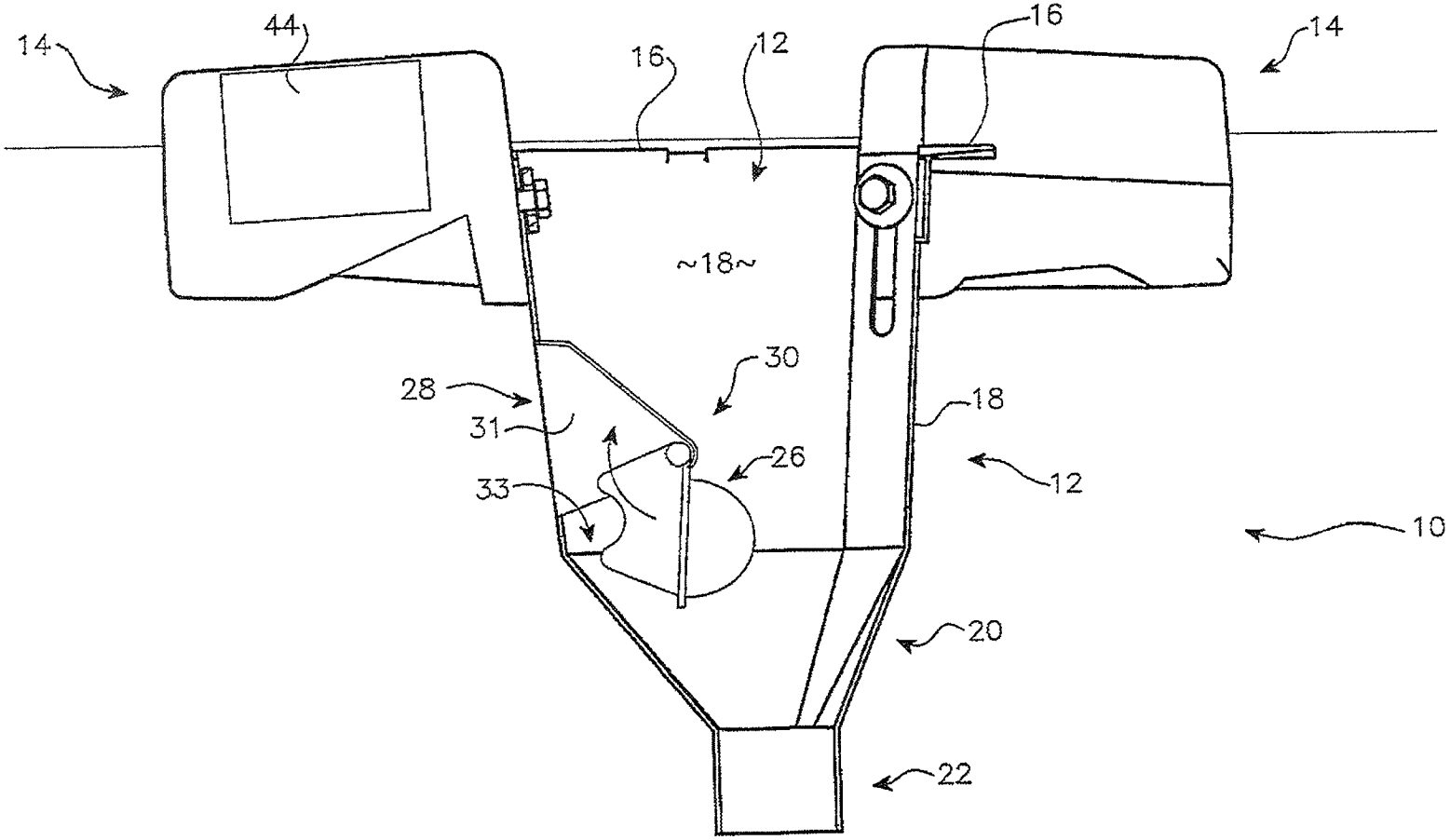
FIG. 2 is a sectioned view of the skimmer device of FIG. 1.

With reference also now to FIG. 2, collecting element 12 includes a liquid control valve 30 located at an aperture 28 in one of the generally vertical walls 18. The control valve 30 includes a pivoting hollow body 26 responsive to liquid levels in the collecting element 12. The liquid control valve 30 pivots within a support structure 31 between a first open position as shown in FIG. 2, in which the liquid control valve permits a flow of liquid into the funnel portion 20 through the aperture 28, and a second position in which the liquid control valve prevents the flow of liquid from the aperture 28 into the funnel portion 20.

When the skimmer device 10 is positioned in a body of liquid and is at rest, the collecting element 12 and weirs 16 are preferably located below the liquid's surface and the buoyancy elements 14 ensure that the weirs 16 are positioned preferably just below the liquid's surface. Also when at rest, the control valve 30 is closed as the buoyancy elements 12 ensures that the control valve 30 closes the opening 33 due to the upwards pressure of the liquid within the collecting element 12 on the hollow body 26.

When suction is applied to the spigot 22, the liquid within the collecting element 12 is sucked out through the spigot 22 and therefore liquid on the surface of the body of liquid is drawn over the weirs 16 into the collecting element 12. As the ballasted buoyancy elements 14 are designed for a skimming operation of the skimmer device 10, only a small amount of liquid is drawn over the weir 5 weirs thus also removing any debris located on the liquid's surface.

As the suction through the spigot 22 lowers the liquid level within the collecting element 12, the collecting element 12 tends to become more buoyant and therefore rises within the liquid. In the preferable operation of the device, before the weirs 16 are forced upwardly out of the liquid, the pressure differential between the liquid on the outside of the collecting element 12 and within the collecting element 12 opens the control valve 30 by forcing the pivotal control valve 30 open. It is possible for the weirs 16 to break the surface of the liquid and rise above the surface. This allows liquid to flow through the valve opening 33 into the collecting element 12 thus rectifying the level and pressure differential. As the differential is rectified, the control valve 30 then once again closes and the collecting element 12 changes direction and begins to travel in a downward direction.

The ballast system (described in detail below) provides inertia to the skimmer device 10 in ensuring that there is a pressure differential between the liquid externally and internally of the collecting element 12 and to provide an inertia in the downward stroke which maintains the skimmer device 10 in the downward stroke, even after the control valve 30 has rectified the level and pressure differential. The buoyancy elements 14 as well as keeping the skimmer device 10 afloat assist in the halting of the downward stroke.

The characteristics of the halt of the downward stroke are determined by the ratio of the buoyancy of the buoyancy elements 14 to the weight of the overall skimmer device 10, at the lowest point of the downward stroke. At the end of the downward stroke, the difference between the mass of the skimmer device 10 and its contents, and the mass of the liquid displaced by the skimmer device 10, is less than at the end of its upward stroke.

The valve opening 33 in the preferred embodiment is designed in such a way that there is a delayed response in the ingress of liquid into the collecting element 12 via the opening 33, thereby increasing the oscillatory tendency of the skimmer device 10. The ballasts of buoyancy elements 14 are adjustable, as is their level relative weirs 16 so that the flow of liquid into the collecting element 12 in volume is less than that being drawn from the collecting element 12 through the spigot 22. These adjustments in addition, serve to allow for various liquid densities (as are encountered in salt liquid pools) and pump strengths.

Figure 3:
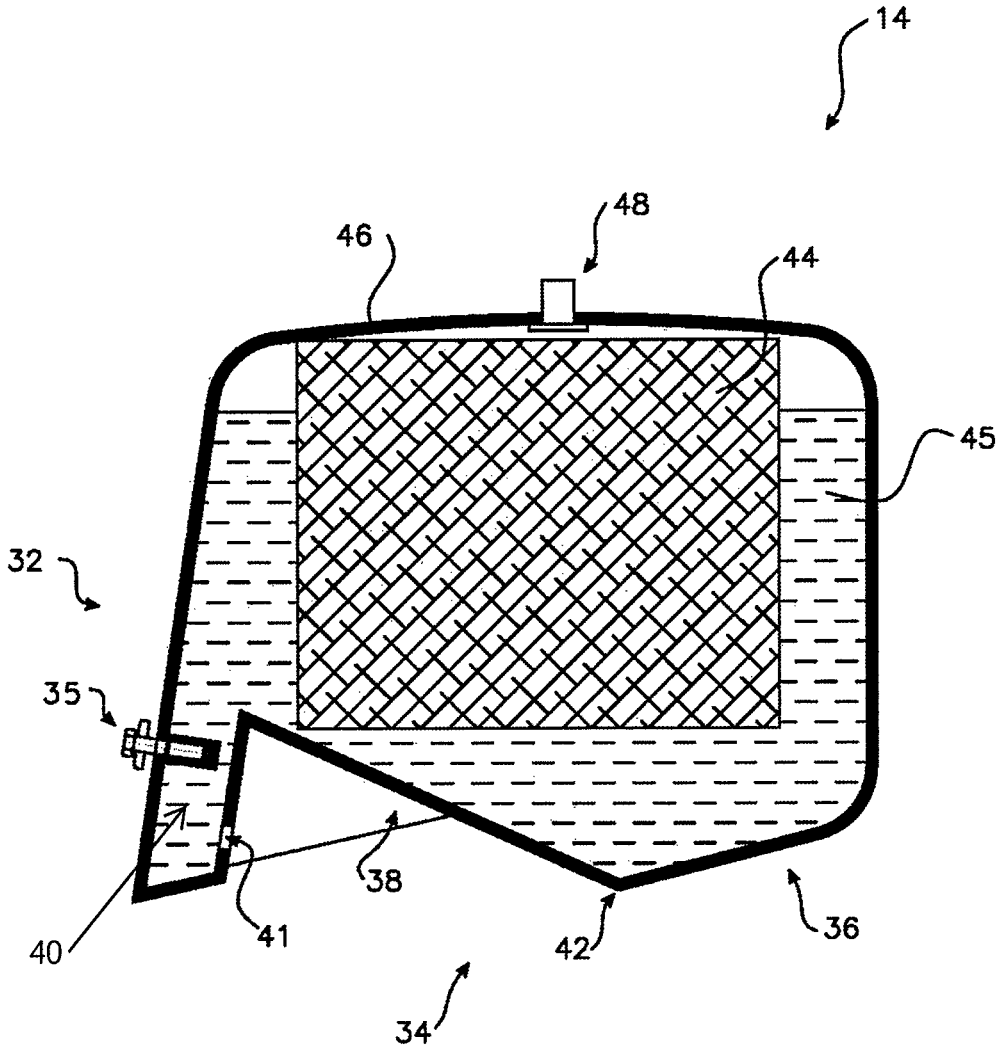
FIG. 3 is a sectioned view of one of the buoyancy elements of the skimmer device of FIGS. 1 and 2.

The buoyancy elements 14 of the skimmer 10 according to a preferred embodiment of the invention, are comprised of hollow chambers, preferably of a generally triangular shape when seen in plan view. With reference now to FIG. 3, an inner end 32 of the chamber is provided with an attachment fastener 35 for sliding engagement in slots (not visible in FIG. 1) of the central collecting element 12. By these means each buoyancy element can be fixed at respective junctions of the weirs 16 and at a desired level relative the level of the weirs.

Each hollow chamber includes a bottom surface 34 formed of a radially outward and upward sloping first portion 36, and a radially inward and upward sloping second portion 38. The second portion 38 extends upwards towards the inner end 32, and towards a hollow liquid inlet shaft 40 extending downwards from an upper end of this second portion 38, extending to proximate the level of the junction 42 between the first and second portions 36 and 38. Inlet shaft 40 is provided with one or preferably two apertures 41 in the surface of the shaft facing sloping second portion 38. The sloping faces of first portion 36 and second portion 38 are so formed to aid in the vertical oscillation described above.

Each of the buoyancy elements 14, prior to sealing, is fitted with a floatation block 44 of impervious cellular polymer material such as a foam, partly filling the hollow chamber of the buoyancy element. Alternatively, instead of a floatation block, the buoyancy element may comprise an hermetically sealed compartment within the hollow chamber.

In at least one preferred embodiment of the invention, the buoyancy element is provided at it upper surface 46 with an air bleed valve 48.

Prior to use, each of the buoyancy elements 14 is ballasted by a controlled charging of a volume of ballast liquid 45 prior to the skimmer device being floated in a body of liquid. Charging may be effected by inverting the skimmer device and holding the buoyancy elements below the surface of the liquid in which the skimmer is to operate, allowing liquid to freely enter the aperture/s 41, until air bubbles cease to be expelled from the buoyancy elements. The skimmer is then returned to its upright working position and allowed to float. Alternatively, ballast liquid may be introduced into the buoyancy element with the device upright, by opening the air bleed valves while the inlet apertures are below the surface of the liquid. Pressure of liquid at the submerged aperture/s 41 ensures the introduced ballast liquid is retained in the chambers of the buoyancy elements when the air bleed valves are closed.

As illustrated in FIG. 2, a certain volume of residual air will remain in the chambers at this point and it is a combination of residual air remaining in the chambers and the floatation blocks which provides the buoyancy of the buoyancy elements.

It will be understood that for a flow of liquid and debris or contaminants to pass over the weirs at an optimum rate commensurate with the capacity of the pump, the level of the weirs at just below the surface of the liquid is critical. While the attachment mechanisms provide a coarse adjustment of buoyancy elements 14 relative the weirs 16, the air bleed valves 48 provide for fine adjustment by allowing some of the residual air to be bled from the chambers.

INDUSTRIAL APPLICABILITY

The ballasting system and the fine adjustment of buoyancy of the skimmer device of the present invention provides for an effective debris and contaminant removal system for bodies of water such as swimming pools.

The combination of the features of the control valve system, in conjunction with the particular shape of the undersides of the buoyancy elements of the skimmer which sets up the vertical oscillation, provides a unique skimming action which prevents build up of debris at the weirs of the device.

The novel arrangement of a ballast system which utilises the liquid in which the skimming device is to operate and counterbalances the positive floatation elements of foam block and residual air provides several important advantages. These include, not only the fine adjustment of buoyancy and therefore increased working efficiency, but greatly add to efficiencies in handling and transport.

The above describes only some embodiments of the present invention and modifications, obvious to those skilled in the art, can be made thereto without departing from the scope of the present invention.

The invention claimed is:

1. A skimmer device for removal of debris and other contaminants from the surface of a body of liquid; said device including a central debris and contaminant collection element supported by outrigger buoyancy elements; said buoyancy elements ballasted by controlled charging of each of said elements with a volume of ballast liquid, and wherein an adjustment of buoyancy is provided by varying a volume of residual air retained in said buoyancy elements, and wherein a combination of a control valve of each said buoyancy element and sloping surfaces at an underside of each said buoyancy element sets up a vertical oscillation of said skimmer device;

wherein said buoyancy of each said buoyancy element is provided by a combination of any said residual air and an impervious cellular polymer body located within a hollow chamber forming each said buoyancy element; and wherein each said hollow chamber includes a bottom surface formed of a radially outward and upward sloping first portion and a radially inward and upward sloping second portion; said second portion extending upwards towards said central debris and contaminant collection element; each said buoyancy element further including a hollow liquid inlet shaft extending downwards from an upper end of said second portion; said liquid inlet shaft extending to proximate a level of a junction between said first and second portions.

2. The skimmer device of claim 1 wherein said second portion sloping upwards towards said central debris and contaminant collection element biases said ballast liquid towards an outer periphery of each said buoyancy element.

3. The skimmer device of claim 1 wherein said sloping surfaces of said first portion and said second portion aid in inducing said vertical oscillation of said skimmer device in use.

4. The skimmer device of claim 1 wherein said liquid inlet shaft is provided with at least one liquid inlet aperture proximate a lower end of said inlet shaft.

5. The skimmer device of claim 1 wherein each said buoyancy element is provided with an air bleed control valve at an upper surface of said hollow chamber.

6. The skimmer device of claim 1 wherein said central debris and contaminant collection element includes three liquid passing weirs; each of said weirs extending between respective pairs of said buoyancy elements.

7. The skimmer device of claim 6 wherein generally vertical walls extend downwards from each said liquid passing weir; said walls further sloping inwards to form a funnel portion; an outlet of said funnel portion formed for connection of an outlet hose.

8. The skimmer device of claim 7 wherein a liquid control valve is located at an aperture in one of said generally vertical walls; said valve including a pivoting hollow body responsive to liquid levels in said central debris and contaminant collecting element.

9. The skimmer device of claim 8 wherein said liquid control valve pivots from a first open position in which said liquid control valve permits flow of liquid into said central debris and contaminant collection element through an aperture in said generally vertical wall, and a second position in which said liquid control valve prevents said flow of liquid into said central debris and contaminant collection element.

10. The skimmer device of claim 9 wherein said liquid control valve remains in said first position while there is a deficiency of liquid flow over said weirs and liquid level in said central debris and contaminant collection element is below said pivoting hollow body.

11. The skimmer device of claim 7 wherein said buoyancy elements are releasably and slidably connected at intersections of said generally vertical walls; sliding engagement providing for individual adjustment of said buoyancy elements relative to a level of said liquid passing weirs.

12. A method of providing adjustable ballasted buoyancy for each of a plurality of buoyancy elements of a skimmer device; said method including the steps of:

a) placing a block of impervious cellular polymer within a hollow chamber of each said buoyancy element, b) allowing ballast liquid to at least partially fill a remaining volume of each said hollow chamber, and c) adjusting a volume of residual air remaining in each said hollow chamber, wherein a combination of a control valve of each said buoyancy element and sloping surfaces at an underside of each said buoyancy element sets up a vertical oscillation of said skimmer device, wherein said buoyancy of each said buoyancy element is provided by a combination of any said residual air and said impervious cellular polymer within said hollow chamber forming each said buoyancy element, and wherein each said hollow chamber includes a bottom surface formed of a radially outward and upward sloping first portion and a radially inward and upward sloping second portion; said second portion extending upwards towards a central debris and a contaminant collection element supported by said buoyancy elements of said skimmer device; said buoyancy element further including a hollow liquid inlet shaft extending downwards from an upper end of said second portion; said liquid inlet shaft extending to proximate a level of a junction between said first and second portions.

13. The method of claim 12 wherein each said buoyancy element is provided with an air bleed valve at an upper surface of each said buoyancy element; said air bleed valve providing said adjustment of said volume of residual air.

14. The method of claim 12 wherein each said control valve is responsive to differential liquid pressures between liquid outside of a debris collecting element and within said element; each said control valve in combination with said ballast liquid inducing said vertical oscillation in said skimmer device in use.

15. The method of claim 14 wherein suction pressure from a pump connected to an outlet of said device induces said differential liquid pressure.

* * * * *